US009907413B2

(12) United States Patent
Goehring

(10) Patent No.: US 9,907,413 B2
(45) Date of Patent: Mar. 6, 2018

(54) SPACE SAVING MANUAL SHELF MANAGEMENT SYSTEM

(71) Applicant: William R. Goehring, Wexford, PA (US)

(72) Inventor: William R. Goehring, Wexford, PA (US)

( * ) Notice: Subject to any disclaimer, the term of this patent is extended or adjusted under 35 U.S.C. 154(b) by 0 days.

(21) Appl. No.: 15/148,370

(22) Filed: May 6, 2016

(65) Prior Publication Data

US 2017/0020302 A1 Jan. 26, 2017

Related U.S. Application Data

(60) Provisional application No. 62/158,062, filed on May 7, 2015.

(51) Int. Cl.
*A47F 1/12* (2006.01)
*A47F 5/00* (2006.01)

(52) U.S. Cl.
CPC ..... *A47F 1/125* (2013.01); *A47F 5/005* (2013.01); *A47F 5/0025* (2013.01)

(58) Field of Classification Search
CPC ..... A47F 1/125; A47F 1/126; A47F 5/0025; A47F 5/005; A47F 7/28
USPC ..... 211/59.3
See application file for complete search history.

(56) References Cited

U.S. PATENT DOCUMENTS 1,702,987 A 2/1929 Wilson
1,703,987 A 3/1929 Butler
2,079,754 A 5/1937 Waxgiser
2,098,844 A 11/1937 Waxgiser
2,652,154 A 9/1953 Stevens
4,042,096 A 8/1977 Smith
4,300,693 A * 11/1981 Spamer ..... A47F 1/126 211/59.3
4,830,201 A 5/1989 Breslow
5,123,546 A * 6/1992 Crum ..... A47F 1/126 206/556
5,160,051 A 11/1992 Bustos
5,413,229 A 5/1995 Zuberbuhler
(Continued)

FOREIGN PATENT DOCUMENTS

CA 2173009 9/1996
JP 2001017290 1/2001
(Continued)

*Primary Examiner* — Ko Hung Chan
(74) *Attorney, Agent, or Firm* — Blynn L. Shideler; Krisanne Shideler; BLK Law Group

(57) ABSTRACT

A manual, bottom supporting, shelf allocation and management system allocates shelf space among rows of products and moves products toward the shelf front and includes a plurality of adjacent shelf allocating and managing units. Each unit includes a base and at least one removably attached side divider wherein at least one row of products may be positioned on the base immediately adjacent the side divider. Each unit is a modular tray which may be, while filled with at least a single row of products, lifted clear of the shelf and moved to another shelf location. The base and side divider are coupled to allow the side divider to move forward and backward relative to the base. A backstop is attached to the rear of the side divider so that the products may be moved towards the shelf front when the side divider is drawn forward relative to the stationary base.

19 Claims, 11 Drawing Sheets

(56) References Cited

U.S. PATENT DOCUMENTS

| | | | | |
|---|---|---|---|---|
| 5,458,248 | A | 10/1995 | Alain | |
| 5,542,552 | A | 8/1996 | Yablans et al. | |
| 5,624,042 | A | 4/1997 | Flum et al. | |
| 5,613,621 | A | 5/1997 | Gervasi | |
| 5,634,564 | A | 6/1997 | Spamer et al. | |
| 6,082,556 | A | 7/2000 | Primiano et al. | |
| 6,155,438 | A | 12/2000 | Close | |
| 6,227,386 | B1 | 5/2001 | Close | |
| 6,357,606 | B1 | 3/2002 | Henry | |
| 6,375,015 | B1 | 4/2002 | Wingate | |
| 6,719,151 | B2 | 4/2004 | Close | |
| 6,923,330 | B1 | 8/2005 | Nagel | |
| 6,991,116 | B2 | 1/2006 | Johnson et al. | |
| 7,086,541 | B2 | 8/2006 | Robertson | |
| 7,124,897 | B2 | 10/2006 | Bustos | |
| 7,168,579 | B2 | 1/2007 | Richter et al. | |
| 7,395,938 | B2 | 7/2008 | Merit et al. | |
| 7,631,771 | B2 | 12/2009 | Nagel et al. | |
| 7,792,711 | B2 | 9/2010 | Swafford, Jr. et al. | |
| 7,854,333 | B2 | 12/2010 | Kottke et al. | |
| 8,453,851 | B2 * | 6/2013 | Ciesick | A47F 1/126 211/126.15 |
| 8,851,303 | B2 * | 10/2014 | Crawbuck | A47F 1/12 211/59.2 |
| 2003/0141265 | A1 * | 7/2003 | Jo | A47F 1/126 211/59.3 |
| 2004/0178158 | A1 * | 9/2004 | Close | A47F 1/12 211/59.3 |
| 2005/0258113 | A1 | 11/2005 | Close et al. | |
| 2007/0068885 | A1 * | 3/2007 | Busto | A47F 1/125 211/59.3 |
| 2007/0158281 | A1 * | 7/2007 | Hardy | A47F 1/126 211/59.3 |

FOREIGN PATENT DOCUMENTS

| | | |
|---|---|---|
| WO | 03005862 | 1/2003 |
| WO | 2006019947 | 2/2006 |
| WO | 2009042838 | 4/2009 |

* cited by examiner

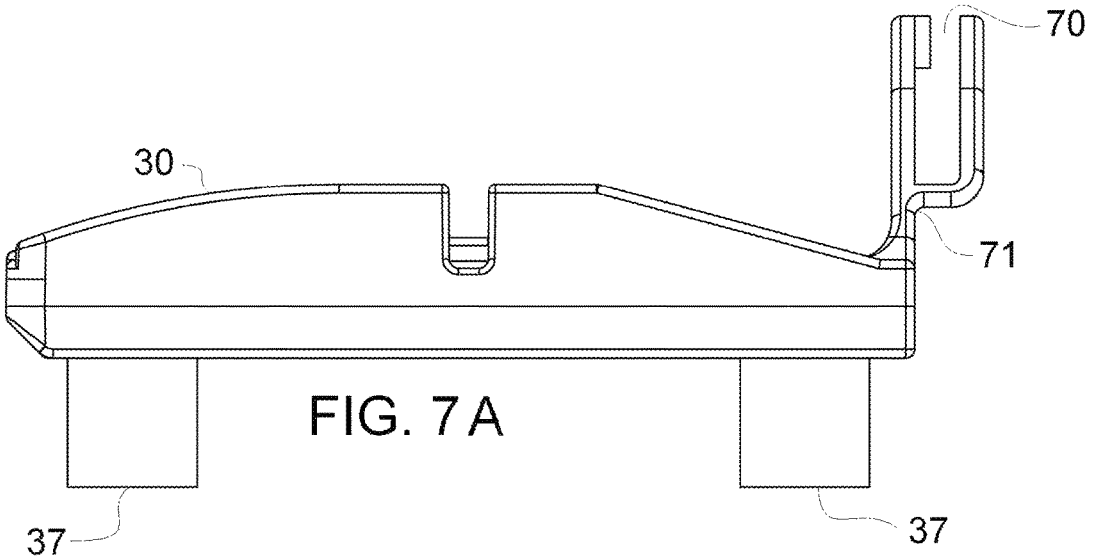
FIG. 7A
FIG. 7B
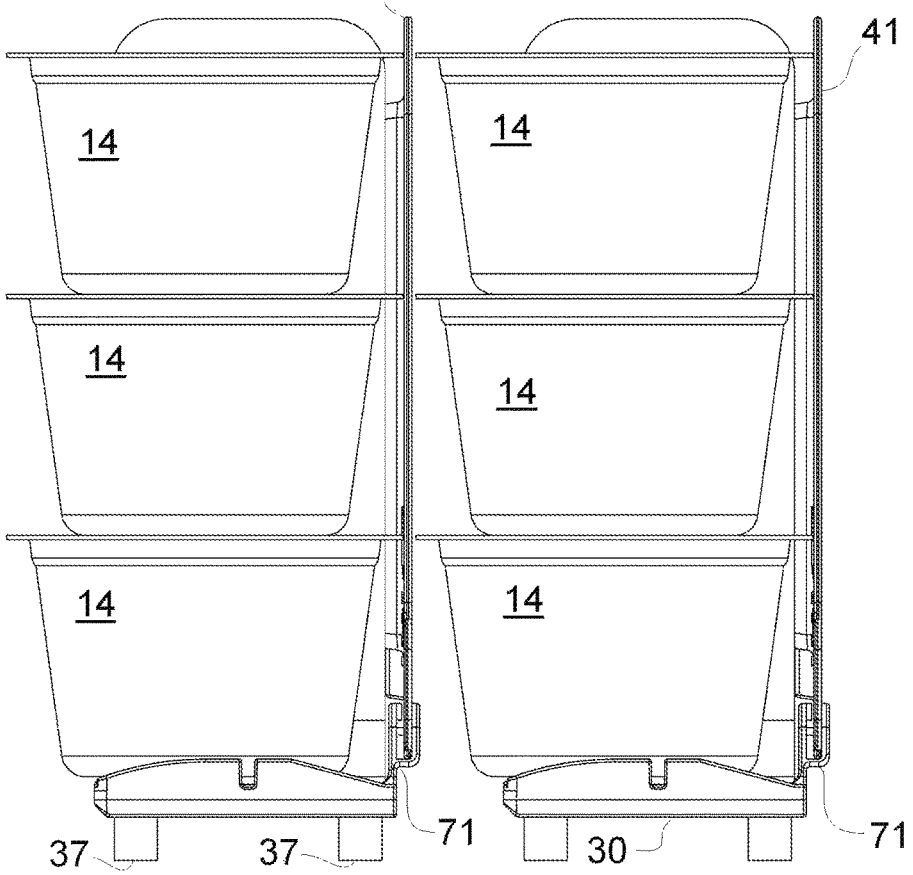

SPACE SAVING MANUAL SHELF MANAGEMENT SYSTEM

RELATED APPLICATIONS

The present application claims the benefit of provisional patent application Ser. No. 62/158,062 filed May 7, 2015 entitled "Space Saving Manual Shelf Management System" which application is incorporated herein by reference.

BACKGROUND OF THE INVENTION

1. Field of the Invention

The present invention relates to manual shelf management systems, and more specifically to a space saving, manual, modular, bottom containing and laterally supporting, shelf management system.

2. Background Information

Labor inefficiencies and other problems result when merchandise is displayed on retail shelves with neither rigid dividers nor a method to bring product forward on the shelf into selling position without handling the merchandise piece-by-piece. These problems pertain to grocery stores and other retail stores where consumer packaged goods, such as food products, spray paint cans and health and beauty care products, are displayed for sale on shelves. With no rigid dividers store personnel must, during product stocking, form rows by approximating straight lines and then finessing products into straight rows. This process is imprecise and time consuming. Further, as new merchandise is fed into rows from the front of the shelf, packages in the middle of the row tend to move to the left or right (known as "snaking") causing packages in the middle or back of the row to be significantly out of alignment with those at the front. This results in wasted labor as store personnel must handle the merchandise multiple extra times to position products in proper row alignment. Another result is shelf disorganization that degrades the shopping experience by making it difficult for shoppers to locate and reach/grasp merchandise. Merchandise is generally always selected by the consumer from the front of the shelf and store personnel are constantly bringing merchandise from the middle and rear of the shelf forward into selling position, a process called fronting. The vast majority of store shelves are fronted using the legacy practice where store clerks grasp individual packages and pull them forward. This manually intensive practice is time consuming and can be counterproductive because, as the store clerk reaches with his hand into the shelf to grasp packages, adjacent merchandise is sometimes knocked out of position which requires the clerk to then re-position that disrupted merchandise before the fronting procedure is completed. Further, the piece-by-piece fronting method is ineffective as typically only one or two items may be easily brought forward into selling position leaving merchandise at the middle and rear of the shelf out of shopper view and inaccessible.

U.S. Pat. No. 9,198,527 (hereinafter the '527 patent), which is incorporated herein by reference, discloses an effective shelf management system for use on retail store shelves, especially on grocery store shelves. The '527 patent also yields an effective description of prior art shelf management solutions that can be helpful in understanding the state of the art. The system of the '527 patent, which is comprised of individual shelf management units, provides effective row separation, provides lateral support for product rows and allows for easy and rapid row fronting. Further, the '527 patent maintains straight product rows and establishes positive row separation which together enhance the shopping experience by facilitating product identification and access. Further, the positive row separation prevents comingling of products on the shelves (where an item moves from its designated row into a different adjacent row) which causes extra work for store clerks, leads to difficulty in determining how much of a given item is stocked on the shelf, and can lead to items becoming "lost" on the shelf such that they do not sell before their expiration date. The '527 patent does not attach to the shelf with mechanical fasteners or permanent adhesives making installation fast and easy. Further, because this system is not attached to the shelf, new product cut-ins and merchandise reconfigurations (called re-sets) are easy to accomplish. As the '527 patent is comprised of individual trays or bases that support individual product rows, re-setting of merchandise is made easier as the units of this system, while loaded with merchandise, can be lifted off and away from the shelf and repositioned on a different shelf location in the store. Further the '527 patent is an easy to manufacture and a low cost system which is a crucial feature for display systems which stores find unattractive if the systems are expensive.

One limitation of the '527 patent is a lack of features to prevent the base of the individual shelf management units of a system from moving objectionably either rearward or forward. The units are designed to slide freely on the shelf surface laterally left and right, and this unimpeded movement is desirable for the purpose of ease of installation, proper seating of the shelf management units between product rows, and facilitation of row repositioning. This lateral movement is held in check by the fact that rows of merchandise are, as a rule, positioned closely side-to-side. There are no features on most shelves nor are there features of typical merchandise configurations, however, to prevent the shelf management units from moving forward or backward. If, for example, the base moves either backward or forward one inch, then the base is out of position both with regard to appearance and function. When the base moves forward or backward store personnel must take time to move the unit back into correct position. As the principal purpose of the system is to decrease labor for store clerks, any extra tasks presented in the operation of the system itself should be minimized or eliminated.

A further limitation of the '527 patent is that, while the individual shelf management units that comprise the system are designed to move freely laterally to the left and right there are some applications where this lateral movement needs to be held in check so that the individual shelf management units do not move out of position.

Another drawback of the '527 patent is a lack of a feature to reduce the likelihood that merchandise packages will fall off the open side of a base of a shelf management unit in those cases where large gaps exist between individual shelf management units such that merchandise on the subject unit is no longer laterally supported on both the left and right side. A related limitation of the '527 patent is a lack of a feature on the back-stop to urge the merchandise packages in a direction away from the open side edge of the base (and towards the divider) so that they are less likely to fall off the base during row fronting. In those cases where the merchandise packages on a shelf management unit are not laterally supported by an immediately adjacent shelf management unit the operation of the row fronting mechanism is facilitated by features that urge the merchandise packages to stay on the base of the subject unit and help prevent them from falling off the open side edge of the unit.

A further limitation of the '527 patent is the possibility that the front of a divider of a shelf allocation and management unit can travel rearward and behind the front of a base of the unit. If the front of the divider travels behind the front of the base of the unit then an operator may have to spend extra time retrieving the front of the divider before it can be positively grasped in order to activate the fronting feature. The lack of a mechanism to prevent the front of the divider from traveling rearward of the front of the base also eliminates the ability of store management to shorten the effective shelf row depth by coupling a shorter divider (with attached backstop) to a longer base.

A further limitation of the '527 patent is a lack of an efficient mechanism for lengthening and shortening the base of the units. The '527 patent discloses a base that may be lengthened or shortened by using a connecting piece which allows separate base sections of varying lengths to be connected to achieve a longer or shorter base in order to accommodate various shelf depths within a store. This is inherently inefficient as various base components would need to be manufactured, delivered to the store and maintained indefinitely in the store inventory. Store personnel would be forced to assemble each base as a step in the installation process. If, at a later time, store clerks wanted to move the systems to a shelf of a different depth they might have to order new lengthening or shortening components to make the adjustment, and this could create delays.

A further limitation of the '527 patent is the lack of a method for preventing merchandise with a high center of gravity from tipping backwards. Merchandise with a high center of gravity would include pouches, tall narrow cans, or product stacks (such as stacked yogurt cups).

A further limitation of the '527 patent is that the divider of a unit may be prevented from being pulled forward for row fronting when a unit is on a retail store shelf with a high front lip. Shelves with a high lip on the top front edge are common in refrigerated store sections where yogurt, tubs of cream cheeses and processed meats are displayed for sale.

It is the object of the present invention to address the deficiencies of the prior art shelf management system and provide a highly effective, very low-cost, easy to install and easy to use shelf management system.

SUMMARY OF THE INVENTION

The present invention maintains all of the advantages presented by the '527 patent shelf management system which are rigid dividers that provide positive row segregation and lateral support to the products, an integral fronting mechanism which allows rapid merchandise fronting, a floating tray design where product rows are positioned on top of the tray thereby allowing product rows to be easily repositioned to the left or right or to be moved to another shelf location altogether, and universality in accommodating merchandise of varying widths so that one size of the shelf management system may be used for a range of different merchandise package widths. A manual shelf management system incorporating all of these features will be referenced herein as a '527 patent type shelf management system.

One aspect of the present invention provides a '527 patent type shelf management system with a rear catch attached to the rear of a base of an individual unit where the rear catch prevents the base of the unit from moving forward especially when the divider is pulled as during row fronting.

Another aspect of the present invention provides a '527 patent type shelf management system with a front catch attached to the front of a base of an individual unit where the front catch prevents the base of the unit from moving backward as may occur when new merchandise is placed on the shelf or when the divider is pushed back to the normal or storage position after it has been pulled forward as during row fronting.

Another aspect of the present invention provides a '527 patent type shelf management system with a base surface that is inclined in a lateral direction and towards the divider of a shelf management unit so that the possibility that the merchandise will fall off the side edge of the base of a shelf management unit is reduced.

Another aspect of the present invention provides a '527 patent type shelf management system with a base of a shelf management unit that features a fixed side divider attached to the side edge of a base opposite the side edge to which the sliding side divider is attached so that the two dividers together prevent merchandise from falling off either side of the base.

Another aspect of the present invention provides a '527 patent type shelf management system with a base with anti-skid or magnetic material on the bottom surface that prevents the shelf management unit from moving out of lateral position on the shelf.

Another aspect of the present invention provides a '527 patent type shelf management system with a backstop that is shaped so that, during row fronting, merchandise packages are urged towards the divider and away from the open side edge of the unit.

Another aspect of the present invention provides a '527 patent type shelf management system with a rear gap filler that attaches to the rear of the base (or may be integral to the base) of the units and is configured to be adjusted to protrude at various lengths (for example, from 0.30" to 0.90"), measured rearward from the rear end of the base so that gaps of various sizes between the rear edge of the shelf and the wall behind the shelf may be filled thereby providing front-to-back stabilization of the units of the system.

Another aspect of the invention provides a '527 patent type shelf management system with a stop on the front of the divider of a unit where the stop prevents the front of the divider from traveling rearward of the front of the base.

Another aspect of the present invention provides a '527 patent type shelf management system with a two-piece base that may be lengthened or shortened, via an integral release-and-catch mechanism, in designated increments (e.g. one inch), so that the base of the units may easily and rapidly be lengthened or shortened without the need to disassemble and then re-assemble the base and without the need for additional parts to change the length.

Another aspect of the present invention provides a '527 patent type shelf management system with a non-tipping backstop that prevents products merchandised in a unit with a high center of gravity from falling or tipping over backwards.

A further aspect of the invention provides a '527 patent type shelf management system with a base and divider coupling configuration that raises the bottom of the divider above a high front lip on a shelf enabling the divider to pass over the shelf lip during row fronting.

A further aspect of the invention provides a '527 patent type shelf management system with risers on the bottom of the base of a unit that raise the bottom of the divider above a high front lip on a shelf enabling the divider to pass over the shelf lip during row fronting.

BRIEF DESCRIPTION OF THE DRAWINGS

FIG. 7A is a front elevation view of a shelf allocation and management unit according to one embodiment of the present invention with features that elevate the divider so that the divider may be pulled forward when a unit is on a shelf with a high front lip;

FIG. 7B is a front elevation view of two side-by-side shelf allocation and management units of FIG. 7A showing features that elevate the divider;

DESCRIPTION OF THE PREFERRED EMBODIMENTS

It is noted that, as used in this specification and the appended claims, the singular forms "a," "an", and "the" include plural referents unless expressly and unequivocally limited to one referent. For the purposes of this specification, unless otherwise indicated, all numbers expressing parameters used in the specification and claims are to be understood as being modified in all instances by the term "about." The terms "about" or "approximate" or similar terms within this application will generally mean within 10% unless otherwise noted. Accordingly, unless indicated to the contrary, the numerical parameters set forth in the following specification and attached claims are approximations that may vary depending upon the desired properties sought to be obtained by the present invention. The various embodiments and examples of the present invention as presented herein are understood to be illustrative of the present invention and not restrictive thereof and are non-limiting with respect to the scope of the invention.

Figure 1:
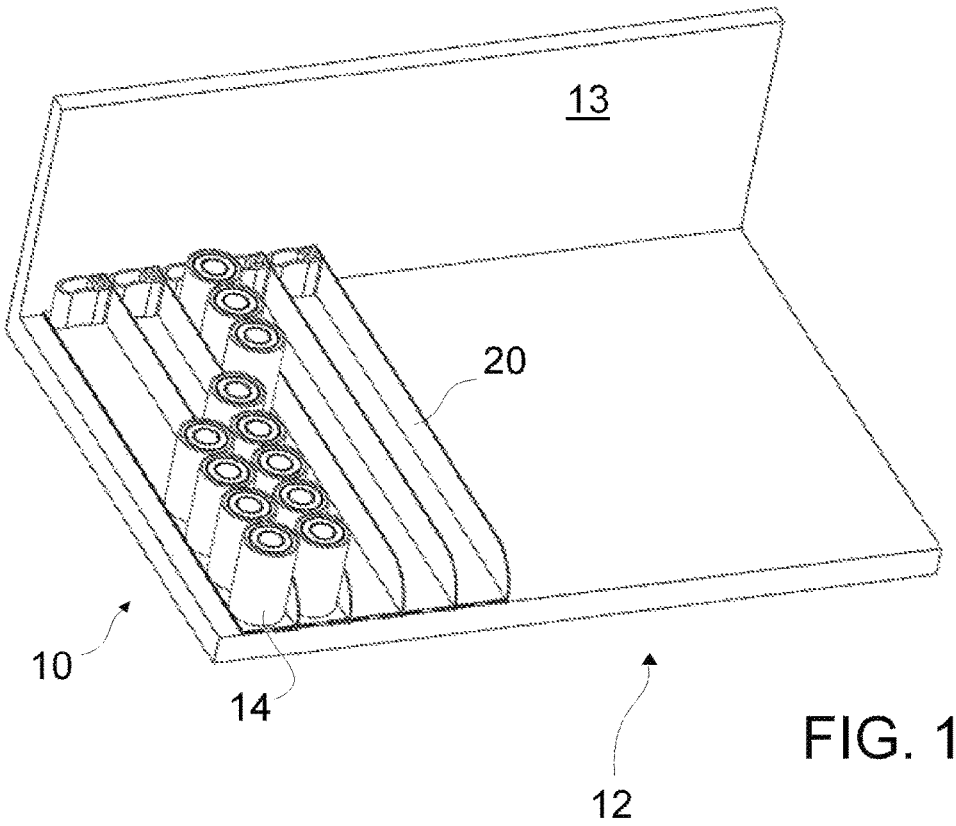
FIG. 1 is a schematic perspective view of the shelf allocation and management system according to one embodiment of the present invention.
Figure 2A:
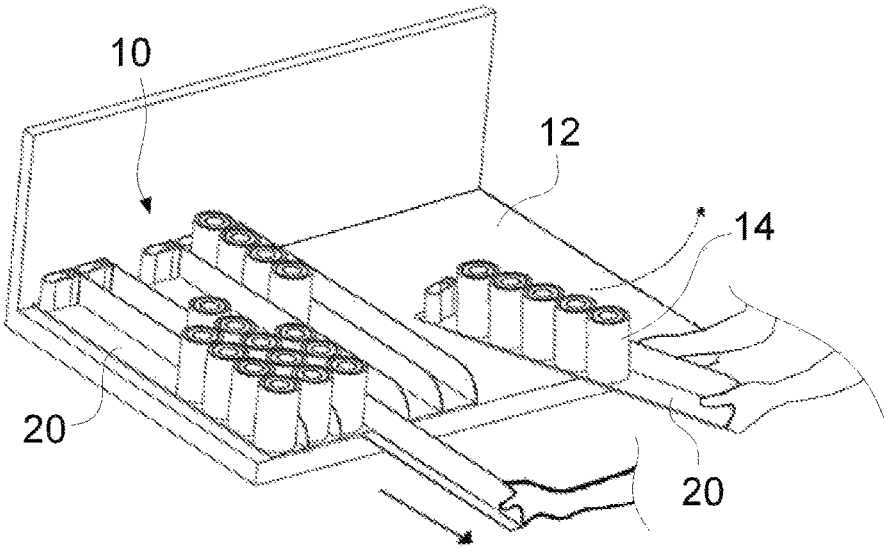
FIG. 2A is a schematic perspective view of the shelf allocation and management system of FIG. 1 showing manual fronting operation of the system and showing the modular nature of the system and a re-setting operation using the system.
Figure 2B:
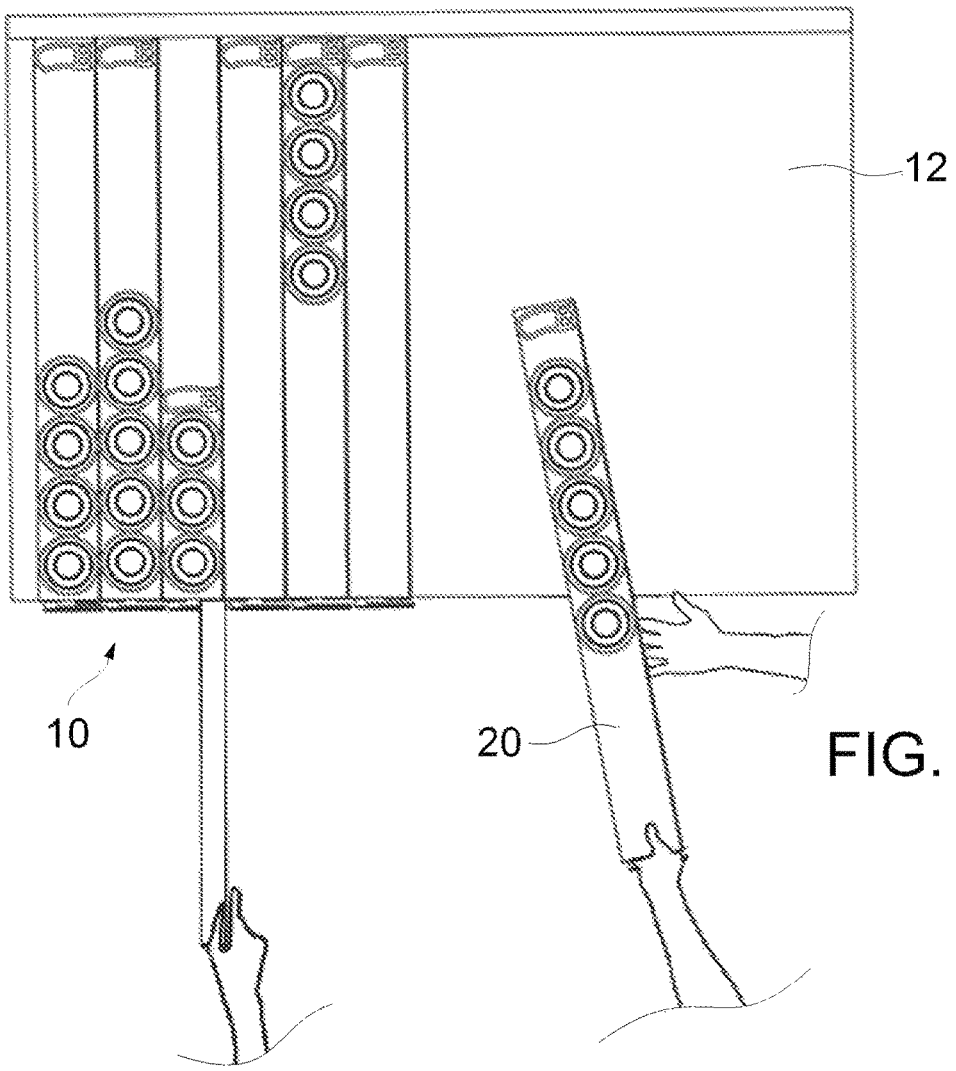
FIG. 2B is an overhead plan view of the shelf allocation and management system of FIG. 2A.

The broad concepts of the operation of the shelf management system 10 of the present invention are found in U.S. Pat. No. 9,198,527, referenced herein as the '527 patent, which issued Dec. 1, 2015, and which is incorporated herein by reference. The present application utilizes common reference numerals as found in the '527 patent and the general construction and operation of a '527 patent type shelf management system 10 is shown schematically in FIGS. 1 and 2A-B. The '527 patent shelf management system 10 includes rigid dividers 40 that provide positive row segregation and lateral support to the products 14 on shelf 12, an integral fronting mechanism via dividers 40 and backstop 60 which allows rapid merchandise fronting, a floating tray design where product 14 rows are positioned on top of the tray or base 30 thereby allowing product rows to be easily repositioned to the left or right or to be moved to another shelf location altogether, and universality in accommodating merchandise 14 of varying widths so that one size of the shelf management system units 20 may be used for a range of different merchandise package widths. A manual shelf management system 10 incorporating all of these features will be referenced herein as a '527 patent type shelf management system 10 and the following disclosure will concentrate on the improvements in a '527 patent type shelf management system 10 while the details of the common components can be found largely in the '527 patent.

Figure 9A:
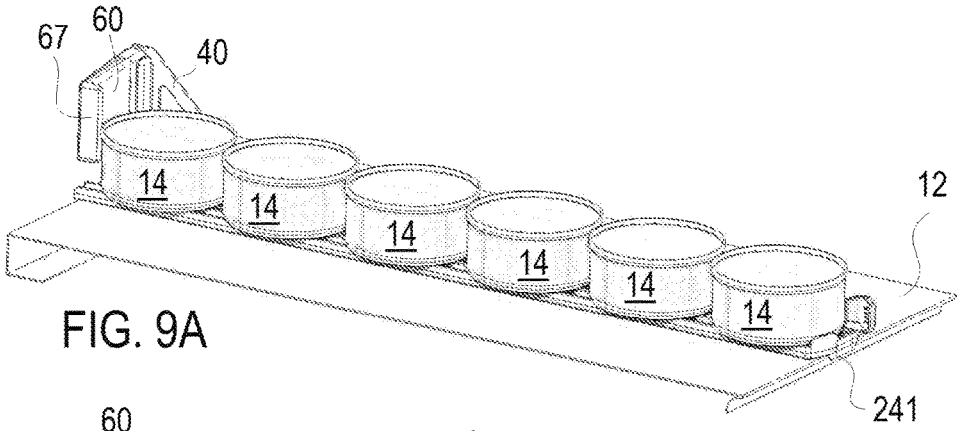
FIG. 9A is a front perspective view of a shelf allocation and management unit according to one embodiment of the present invention.
Figure 9C:
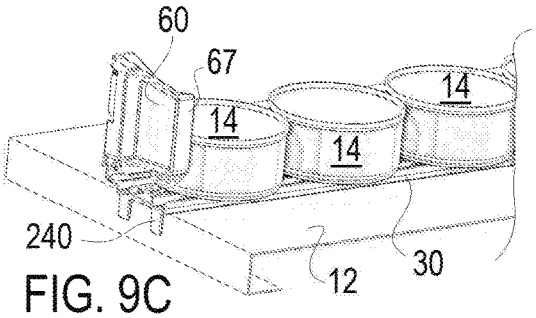
FIG. 9C is an enlarged rear perspective view of the shelf allocation and management unit of FIG. 9A showing a rear catch seated against the rear edge of a retail store shelf.
Figure 9B:
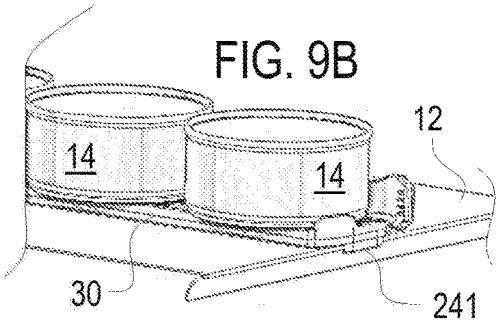
FIG. 9B is an enlarged front perspective view of the shelf allocation and management unit of FIG. 9A showing a front catch seated against the front edge of a retail store shelf.
Figure 9D:
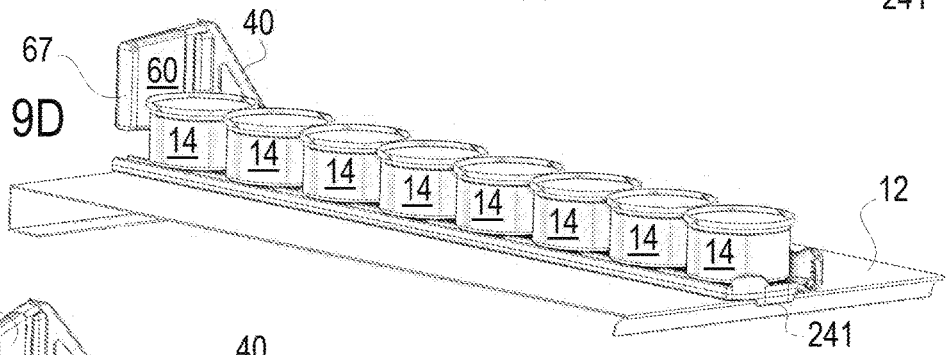
FIG. 9D is a front perspective view of the shelf allocation and management unit of FIG. 9A with a smaller diameter product.
Figure 9E:
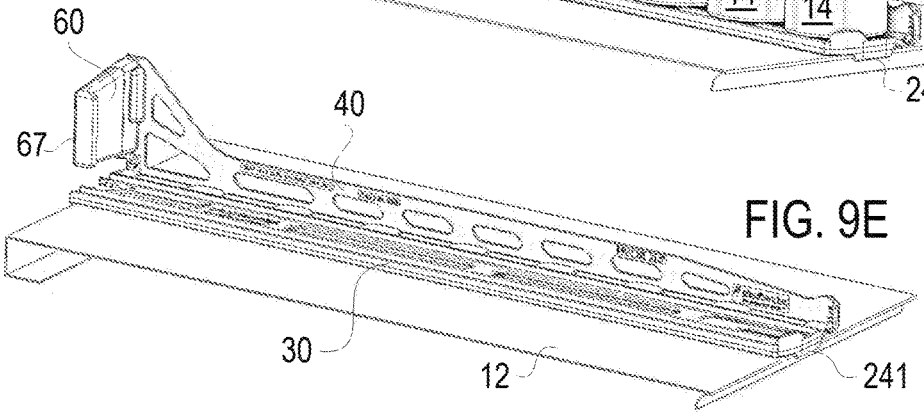
FIG. 9E is a front perspective view of the shelf allocation and management unit of FIG. 9A with the products removed for clarity.

The present invention, as shown in FIGS. 9A-B, D-E and 10A-12 provides a front catch 241 the purpose of which is to make positive arresting contact with the front edge of the shelf 12 thereby preventing backward movement of the base 30 of a unit 20. The front catch 241 may take the form of a piece of plastic (or two or more) or other material that attaches to the front end of the base 30 and protrudes downward approximately 0.20" at more or less a 90-degree angle (+/−5 degrees) in relation to the plane of the base 30 surface. The front catch 241 may extend downward below the bottom of the base 30 from 0.10" to 1.00" with 0.20" being a typical extension length. The extension length of front catch 241 should be long enough to provide significant arresting contact with the front edge of the shelf 12 but short enough so that a price channel of a retail shelf 12 not be visually or mechanically obstructed. When the shelf allocation and management units 20 are placed on the shelf 12 during installation, the unit bases 30 are positioned so that the front catch 241 (or front catches 241) is seated against and touching the front shelf 12 edge such that the bases 30, when installed in a series side-to-side, are maintained in alignment with respect to the front edge of the shelf 12.

The front catch 241 prevents the shelf management unit 20 from moving rearward and out of position with regard to appearance and function. This rearward movement may occur during the stocking of products 14, or may occur when the sliding side divider 40 is pushed rearward into the storage position after row fronting, or may otherwise occur when the units 20 are inadvertently bumped. If, for example, a shelf management unit 20 has moved backwards so that the front of the base 30 is 1.5" rearward of the front edge of the shelf 12 then it would be out of alignment with the units 20 immediately adjacent to the left and right and this would cause a disorderly appearance of the system 10. Using the same example, if the front of the base 30 is 1.5" rearward of the front edge of the shelf 12 then the front of the sliding side divider 40 is likely also 1.5" rearward of the front shelf 12 edge and this may cause the divider handle 280 of the unit 20 to be behind merchandise 14 packages of adjacent rows and this would interfere with the grasping and operation of the divider handle 280 and therefore would degrade the function of a unit 20 of the system 10.

Figure 8:
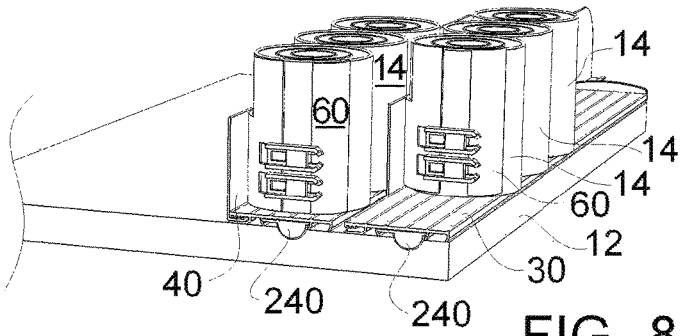
FIG. 8 is a view of the rear of several units of a shelf allocation and management system according to one embodiment of the present invention showing a rear catch seated against the back edge of a retail store shelf.
Figure 10A:
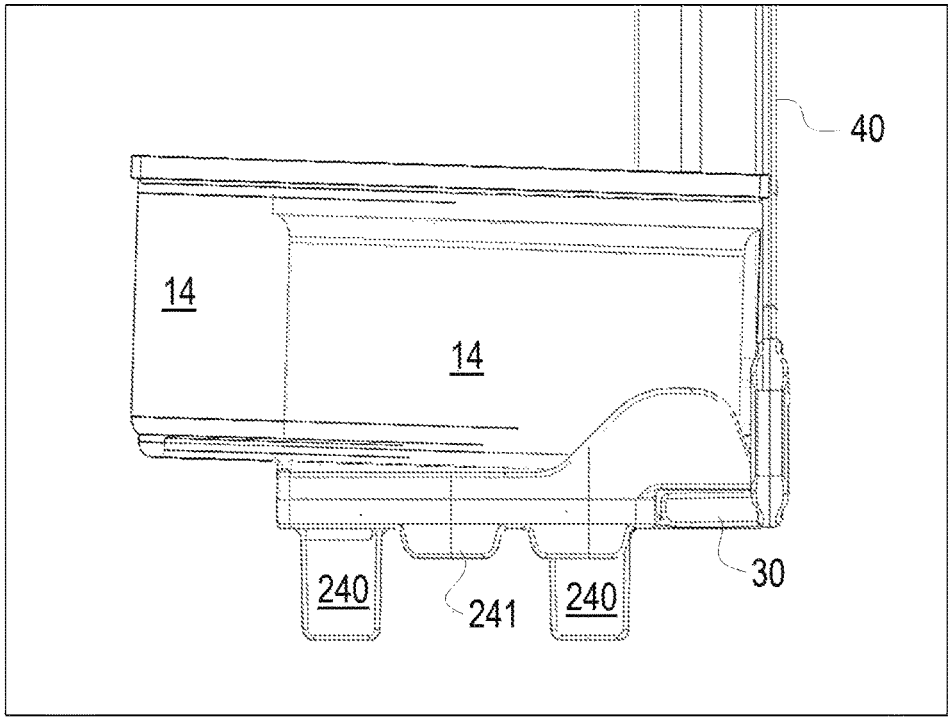
FIG. 10A is a front elevation view of a shelf allocation and management unit according to one embodiment of the present invention showing a top surface of a base that is inclined in a lateral direction.

A further aspect of the present invention as shown in FIGS. 8, 9C, and 10A provides a rear catch 240 the purpose of which is to make positive arresting contact with the rear edge of the shelf 12 thereby preventing forward movement of the base 30 of a unit 20. The rear catch 240 may take the form of a piece of plastic (or multiple pieces/tabs) or other material that attaches to the rear end of the base 30 and protrudes downward approximately 0.50" at more or less a 90-degree angle (+/−5 degrees) in relation to the plane of the base 30 surface. The rear catch 240 may extend downward below the bottom of the base 30 from 0.25" to 1.00" with 0.50" being a typical extension length. The extension length of rear catch 240 should be long enough to provide significant arresting contact with the rear edge of the shelf 12 but short enough so that the unit 20 may be lifted up and away from the shelf 12 without undue effort. When the shelf allocation and management units 20 are placed on the shelf 12 during installation, the unit bases 30 are positioned so that the rear catch 240 (or rear catches 240) is seated against and touching the rear shelf 12 edge such that the bases 30, when installed in a series side-to-side, are maintained in alignment with respect to the rear edge of the shelf 12, and, therefore, are maintained in alignment with the front edge of the shelf 12.

In addition to maintaining the shelf management units 20 in proper front-to-back alignment, the rear catch 240 prevents the units 20 from moving forward when the divider 40 is pulled forward as when actuating the fronting mechanism. Objectionable forward movement may mean movement of the front of the base 30, for example, two inches forward of the front of the shelf 12. If the units 20 in a system 10 move inadvertently forward during row fronting then the store clerks must take extra time to re-position the units 20, which is wasted time. A further advantage of the rear catch 240 preventing unwanted forward movement of the units 20 during row fronting, is that store clerks need not use their free hand to hold the base 30 steady when pulling the divider 40 forward. This frees up the clerk's second hand so that an adjacent shelf management unit 20 may be fronted enabling two units 20 to be fronted simultaneously.

In an alternate embodiment, two rear catches 240, one on the left side and the other on the right side, may be positioned at the rear of base 30 so that in the case, for example, when there is an obstacle at the rear of the shelf on one or the other side of the rear of base 30 one of the rear catches 240 may be snapped off leaving the other in place.

Figure 10B:
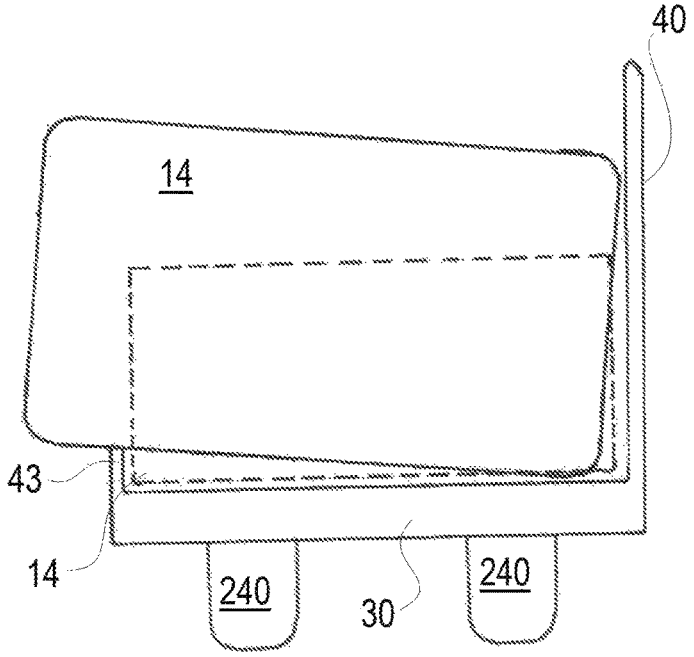
FIG. 10B is a front elevation simplified schematic view of a shelf allocation and management unit according to one embodiment of the present invention showing a base featuring a fixed side divider that provides lateral containment for a narrower product and an inclined base that urges a wider product in a lateral direction away from the open end of the base.

A further aspect of the present invention, as shown in FIGS. 10A and B, provides a laterally inclined base 30 which is inclined slightly in a lateral direction so that the force of gravity urges merchandise 14 positioned on the base 30 towards the side of the base 30 to which a side divider 40 or 43 is attached. The shelf management units 20 of the '527 patent feature a side divider 40 positioned on the right side of the base 30 while the left side of the base 30 is open and provides no lateral containment. The '527 patent also discloses an embodiment where the side divider 40 is attached to the left side of the base 30. In any case, the lateral incline on the base 30 of the present invention is configured so that the merchandise 14 packages are urged towards the side of the base 30 to which the side divider 40 is attached. The base 30 includes "rails" which are raised elements that the product 14 rests and slides upon. The incline in the base 30 may be easily formed by having one rail distal from the divider be slightly higher than the rail closest to the divider, with the angle of incline measured between a line (or plane) connecting the tops of the rails of the base 30 and the plane of the shelf 12. The amount of incline should be slight so as not to disrupt the appearance or stacking of the products, namely less than 20 degrees and generally 3 to 5 degrees. Additionally if there are more than two rails on the base 30 the height of the intermediate rails should also follow the defined angle of incline such that the tops of all the rails lie in a common plane such that all rails would be used to support the products, however it is possible for a system 10 to be designed for two product types, as shown schematically in FIG. 10B (which has been simplified to illustrate this concept), in which the outer rail defines an incline for one large product type and for a smaller diameter (base diameter) of product 14 the product actually rests inside of the outer rail of the base 30 which then acts as a fixed side divider 43 (discussed below in connection with FIG. 11). In this embodiment the rails (only one of which is shown in schematic FIG. 10B) may not all be along the same line because the rail sets may form distinct inclined angles for the distinct products. Specifically in FIG. 10B the floor of the base may be considered one rail set that defines one slope and the rail/side divider and the portion of the floor supporting the larger diameter product 14 as shown form a second rail set at a second inclined angle.

The system 10 is comprised of a series of shelf management units 20 positioned on a shelf 12 immediately adjacent one another so that merchandise 14 packages positioned on the base 30 of a shelf management unit 20 are contained on the right side by the side divider 40 of that unit and are contained on the left side by the side divider 40 of the unit 20 immediately adjacent and to the left. In those case, however, where a large gap is presented between the subject unit 20 and the unit 20 immediately to the left then the merchandise 14 packages on the subject unit 20 may no longer be contained on the left side and may fall off of the base 30. A large gap between adjacent units 20 may occur in cases where the merchandise 14 on the left of the subject unit 20 is completely sold out, in the case where units 20 are missing, or in a case where, for whatever reason, store management has configured the merchandise 14 on the shelves 12 so that large gaps exist between product rows. In any case where a large gap exists immediately adjacent to the subject unit 20 it is helpful for the base 30 to be configured with an incline that urges, through force of gravity, the merchandise 14 packages towards the side divider 40 thereby decreasing the likelihood that the packages 14 will fall off the left side of the base 30. If packages fall off the base 30 then this causes a disorderly appearance and also impedes proper stocking of new merchandise 14 and further impedes row fronting.

An incline of approximately 3 to 5 degrees is generally sufficient although an incline of as little as 2 and as much as 20 degrees may be used. The use of a laterally inclined base 30 is most useful in those cases where a merchandise 14 package has a low center of gravity. For example, cat food cans, tuna fish cans and cans of beans have a low gravity center while tall thin packages such as air freshener aerosol cans and boxes of macaroni and cheese have a high center of gravity. The direction of the incline should be in a lateral direction and at a 90-degree angle in relation to the length of the base 30.

Figure 11:
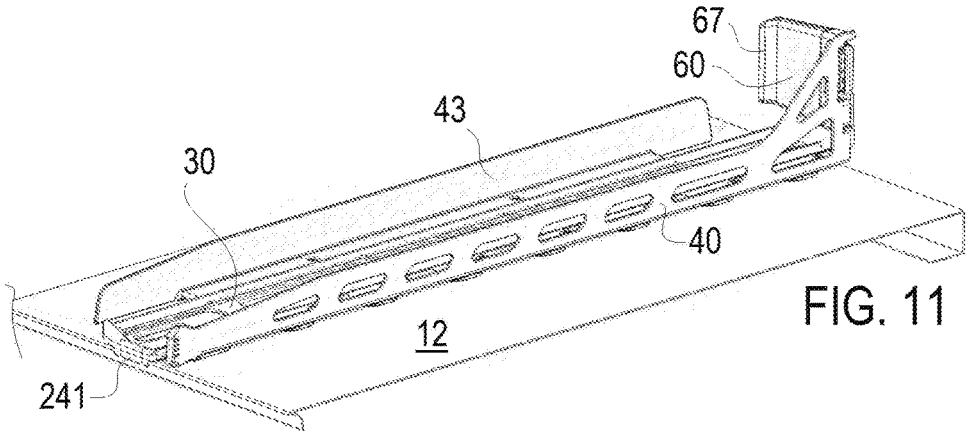
FIG. 11 is a view of a shelf allocation and management unit according to one embodiment of the invention with a fixed side divider attached to the side of the base opposite the side to which the sliding side divider is attached.

A further aspect of the present invention, as shown in FIG. 11, provides a base 30 of a shelf management unit 20 featuring a fixed side divider 43 attached to side edge of the base 30 opposite the side of the base 30 to which the sliding side divider 40 is attached. The fixed side divider 43 extends upward from the side edge of the base 30 in a perpendicular direction and may be from less than one tenth of one inch in height, or one inch in height, or may be as high as seven inches or greater. A significant feature of a '527 patent type shelf management system 10 is a design that allows the merchandise 14 packages positioned on the base 30 to hang off the side of the base 30 opposite the side to which the sliding side divider 40 is attached. This design minimizes the amount of lateral shelf 12 space consumed by the system 10 as the only lateral space occupied by an individual shelf management unit 20 is the thickness of one sliding side divider 40, and this thickness is typically less than one-tenth of one inch. There are some merchandise 14 packages, however, that are shaped so that, when two of these packages 14 are positioned side-by-side, a large lateral gap is presented between the two packages 14 (large top rimmed cans, for example, and frusto-conical or side diverging cans). This gap in some cases may be so large that a base 30 with sliding side dividers 40 and fixed side divider 43 attached to either side of the base 30 could be used without causing any lateral displacement between the merchandise 14 packages that is greater than the gaps that naturally exist. Using the 3 oz. aluminum cat food can as an example, when two of these cans 14 are positioned side-by-side a gap is presented between the two cans 14 below touching top rims that is approximately 0.18" wide. In some embodiments a '527 patent type shelf management system 10 features a divider that is 0.070" thick. If a fixed side divider 43 is added to the base 30 then, for example, we may have a 0.070" thick sliding side divider attached to one side edge of the base 30 and a 0.070" fixed side divider attached to the other side edge of the base 30. If two of these "two divider" shelf management units 20 are positioned on a shelf 12 side-by-side then the total lateral displacement of the two immediately adjacent (and touching) dividers 40 and 43 (the right-side divider of the unit to the left and the left-side divider of the unit to the right) would equal 0.14", and this is less than the 0.18" gap presented by the two adjacent cat food cans per the example cited above. So this is a case where shelf management units 20 featuring dividers 40 and 43 both on the left side and the right side of the base 30 could be used without causing lateral displacement between product rows that would reduce number of rows of merchandise 14 that could be placed on the shelf 12.

As noted above with the inclined base 30 and shown in FIG. 10B it is possible for one set of products 14 that the outermost rail of the base 30 forms the angle of incline for large diameter products and the outermost rail forms the low height (extremely low height) fixed side divider 43 for a smaller base diameter of products 14, particularly where the gap below the touching upper rims of adjacent small diameter products 14 is less than the combined width of the dividers 40 and 43. Thus in some cases the base 30 of a shelf management unit 20 will feature a sliding side divider 40 and fixed side divider 43 and will also feature a laterally inclined base 30. The combination of these three features will be useful in cases where a particular section of a retail store may display merchandise packages 14 that are both narrow and wide and where the narrow packages 14 may be contained on the base 30 by the use of the fixed divider 43 and the wide packages 14 may be contained on the base 30 by the use of the laterally inclined base 30.

Figure 13:
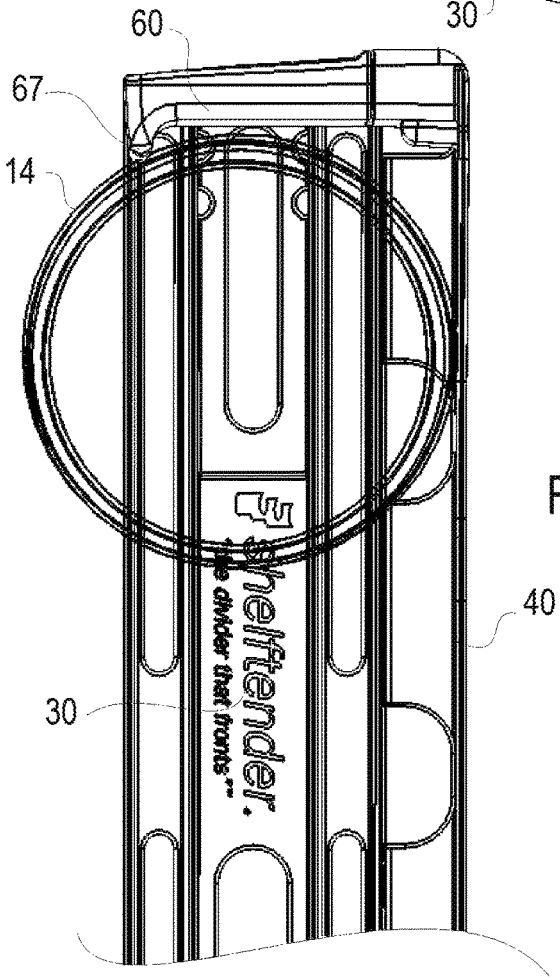
FIG. 13 is a top plan view of a shelf allocation and management unit according to one embodiment of the present invention showing a backstop configured to urge merchandise packages away from the open side edge of the base.

The inclined base 30 described above and the fixed divider 43 help contain the products 14 on the tray or base 30 of each unit 20 of the system 10. Additionally the backstop 60 may have an engagement projection 67 as shown in FIGS. 9A, 9C-E, 11 and 13. As best shown in FIG. 13 the engagement projection 67 engages the rearmost product 14 on an opposite side of the centerline of the product 14 from the moveable divider 40. This alignment results in urging at least the rearmost product 14 toward the divider 40 during fronting. Physically this configuration induces a torque about the center of the product during fronting the result of which is urging the rearmost product toward the divider 40, and will help maintain all of the products in the desired position in the row.

Figure 12:
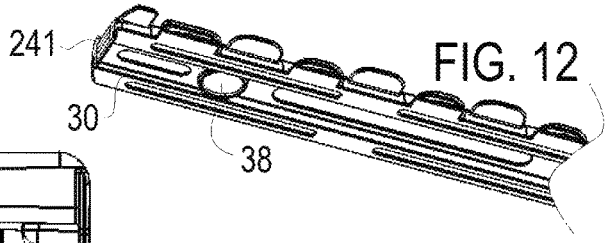
FIG. 12 is a bottom perspective view of a shelf allocation and management unit according to one embodiment of the invention showing anti-skid material affixed to the bottom surface of the base.

A further aspect of the present invention, as shown in FIG. 12, provides for anti-skid material 38 to be placed on the bottom surface of the base 30 of a shelf management unit 20. The individual shelf management units 20 of the '527 patent system 10 are designed to move freely laterally to the left and to the right. In some cases, though, this free lateral movement is not desirable, and this is especially true in cases where large gaps exist, or could potentially exist, on either side of a shelf management unit 20. In these cases it is helpful if the bases 30 of the shelf management units 20 may be made to stay in position as through the use of an anti-skid material 38 being placed on the bottom surface of the base 30 which causes the base 30 to partially adhere to the shelf 12. This anti-skid material 38 may either be in the form of a releasable adhesive material or in the form of a magnet. A moderate amount of adhesion is desirable so that just enough resistance to skidding is presented in order to keep the shelf management units 20 in proper position but not so much adhesion that the units 20 become virtually attached to the shelf 12 as this would make difficult the re-positioning of shelf management units 20 as is required with new merchandise 14 cut-ins and merchandise 14 re-sets, etc. As most all retail store shelves 12 are made of steel, the anti-skid material 38 may also be in the form of magnets positioned on the bottom surface of the base 30. FIG. 12 shows anti-skid material 38 in the form of a disc selectively attached to the base 30 (as needed). The material 30 does not need to be in this shape but can take any number of shapes, but a single disc that is selectively applied represents an easy implementation of this concept.

Figure 3A:
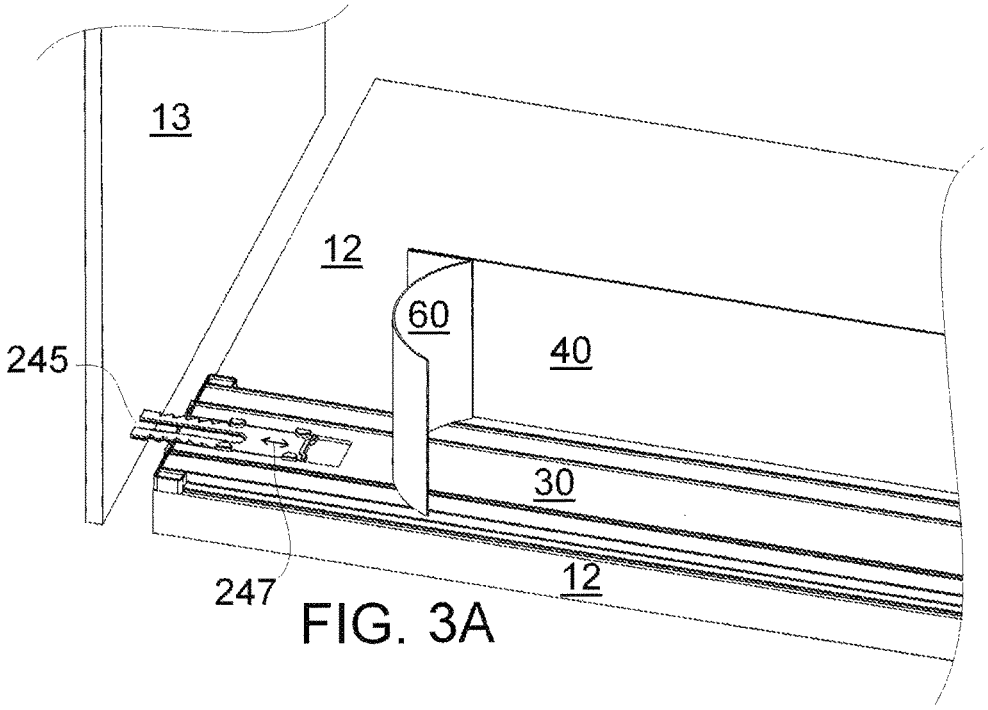
FIG. 3A is a view of a portion of a shelf allocation and management unit according to one embodiment of the present invention showing a rear gap filler attached to the rear of the unit and further showing the direction of movement of a rear gap filler that, in some embodiments, allows for adjustment according to various gap lengths that exist behind a shelf.
Figure 3B:
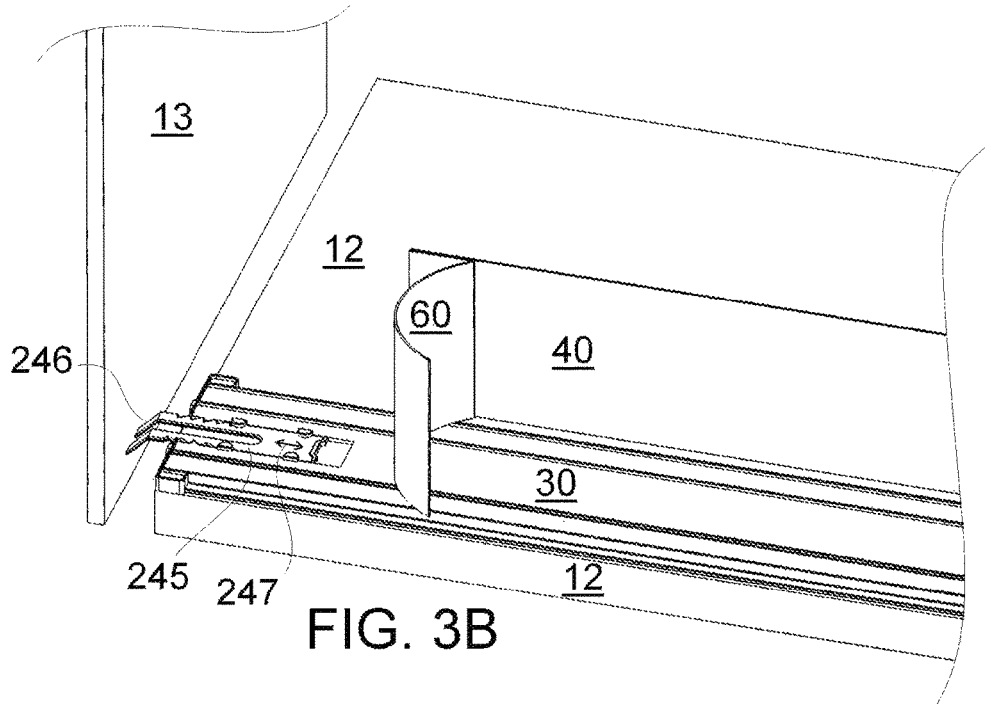
FIG. 3B is a view of a portion of a shelf allocation and management unit according to one embodiment of the present invention showing a rear gap filler also incorporating a flexing mechanism that provides constant forward pressure on the gap filer and therefore constantly urges the entire shelf allocation and management unit forward.

A further aspect of the present invention, as shown in FIGS. 3A and 3B, provides a rear gap filler 245 that is attached to the rear end of the base 30 of the unit 20. In some cases the front catch 241 cannot be used because it causes a mechanical or visual obstruction to the display of product and price information at the front edge of the shelf 12 or because a high lip is present at the front edge of the shelf 12. In these cases the shelf management unit 20 may be held in longitudinal position through the use of a rear gap filler 245.

The rear gap filler 245 protrudes directly rearward from the rear end of the base 30. The gaps that exist between the rear of the shelf 12 and the wall 13 behind the shelf 12 generally range between 0.10' and 1.00" with a typical gap being 0.50". The rear gap filler 245 may be integral to the rear of base 30 and of a fixed length or may be a separate piece (as shown in FIGS. 3A and 3B) that may be attached to the rear of the base 30 in a variety of positions such that gaps of various lengths may be addressed via adjustment.

Whether integral to the base 30 or a separate part, the gap filler 245 may feature a spring-biased flexing mechanism 246, as shown in FIG. 3B, which would enable the rear terminus of the gap filler 245 to maintain constant contact with the wall 13 behind the shelf 12 and would exert, via spring bias, constant pressure against the wall 13 thereby exerting force on the base 30 such that the base 30 would be constantly urged forward (away from the wall 13) and would therefore maintain the unit 20 in a substantially stationary front-to-back position, which is ideal.

Figure 4:
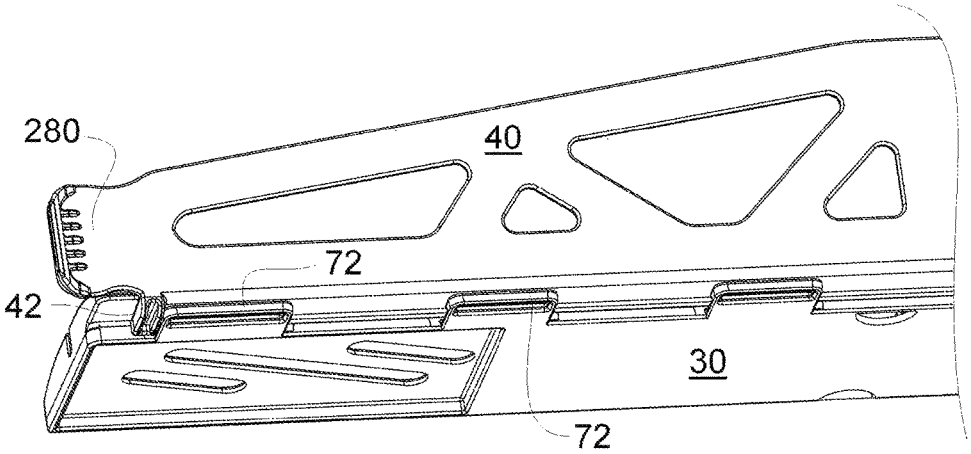
FIG. 4 is a view of a shelf allocation and management unit according to one embodiment of the present invention showing an arresting feature on the front of the divider which prevents the front of the divider from traveling rearward of the front of the base.

A further aspect of the present invention as shown in FIG. 4 is a divider stop 42 which prevents the front of the sliding side divider 40 from moving rearward past the front of the base 30 of a shelf allocation and management unit 20. In one embodiment divider stop 42 is integral to the front of connecting tab 50 of sliding side divider 40 and is in the form of a protruding element designed to butt against the front or opening of channel 70. For an injection-molded base 30, divider stop 42 will butt against the front of the front-most channel tooth 72 on the side of base 30. (Injection molding is the preferred method of manufacturing for base 30. An injection-molded base 30 features alternating channel teeth 72 to form base channel 70.) One advantage of divider stop 42 is that the sliding side dividers 40 of units 20 will be kept in the same position relative to the front of base 30 thereby promoting a neat appearance of a series of units 20 forming a system 10. A second advantage is that divider stop 42 prevents sliding side divider 40 from traveling rearward of the front of the base 30 and therefore maintains the divider handle 280 in a position where it can be easily grasped for the purpose of actuating the row fronting feature. A divider stop 42 presents a third advantage in that it arrests the front of the sliding side divider 40 at the front of the base 30 thereby allowing store management to shorten the effective depth of the row of products 14 by using a sliding side divider 40 (with attached backstop 60) that is shorter than the base 30.

A further aspect of the present invention is a base 30 of a unit 20 that is comprised of two pieces and may be adjusted in length through attaching the two pieces in various positions relative to each other. Length adjustment of the base 30 is desirable so that the base 30 may be fitted to shelves 12 of varying depths. The two components of the length-adjustable base 30 would typically be delivered to the store coupled together so installation would entail merely length adjustment and not assembly. The length-adjustable base 30 would have an adjustment range which would allow use across the variety of shelf 12 depths found, for example, in a typical grocery store. For instance an individual grocery store might use shelves 12 that are 17.5", 19.5", 21.5" and 24.5" in depth. A length-adjustable base 30, therefore, may, in some embodiments, be adjustable in one-inch increments between, 17.5" and 24.5".

Figure 5A:
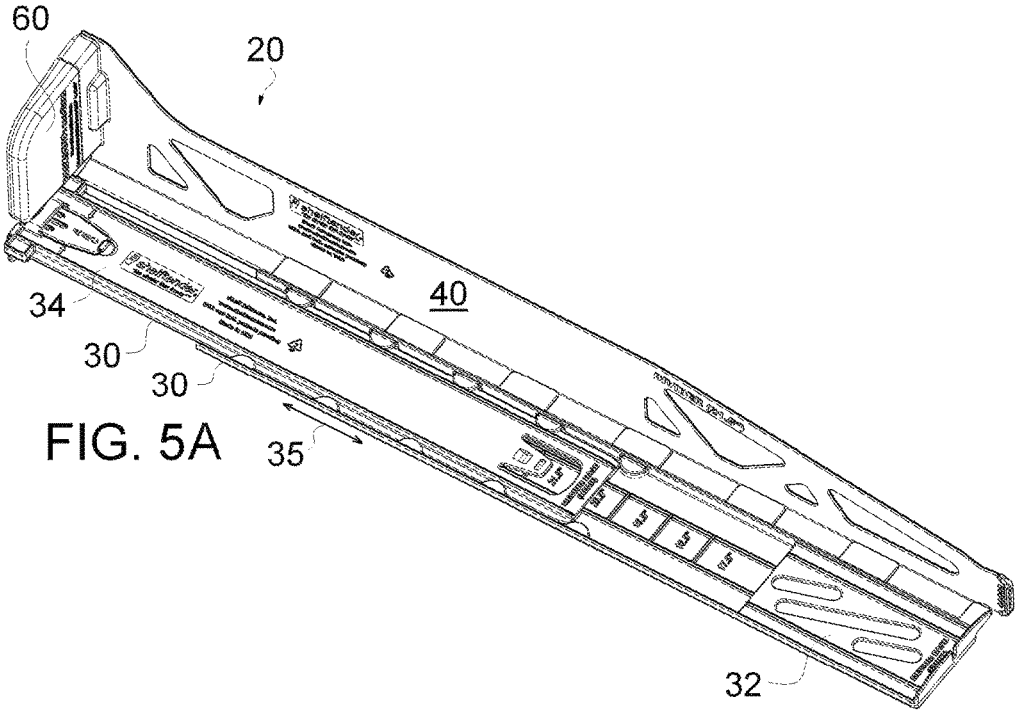
FIG. 5A is a view of a shelf allocation and management unit according to one embodiment of the present invention showing a two-piece base that may be adjusted in length using a telescoping design.
Figure 5B:
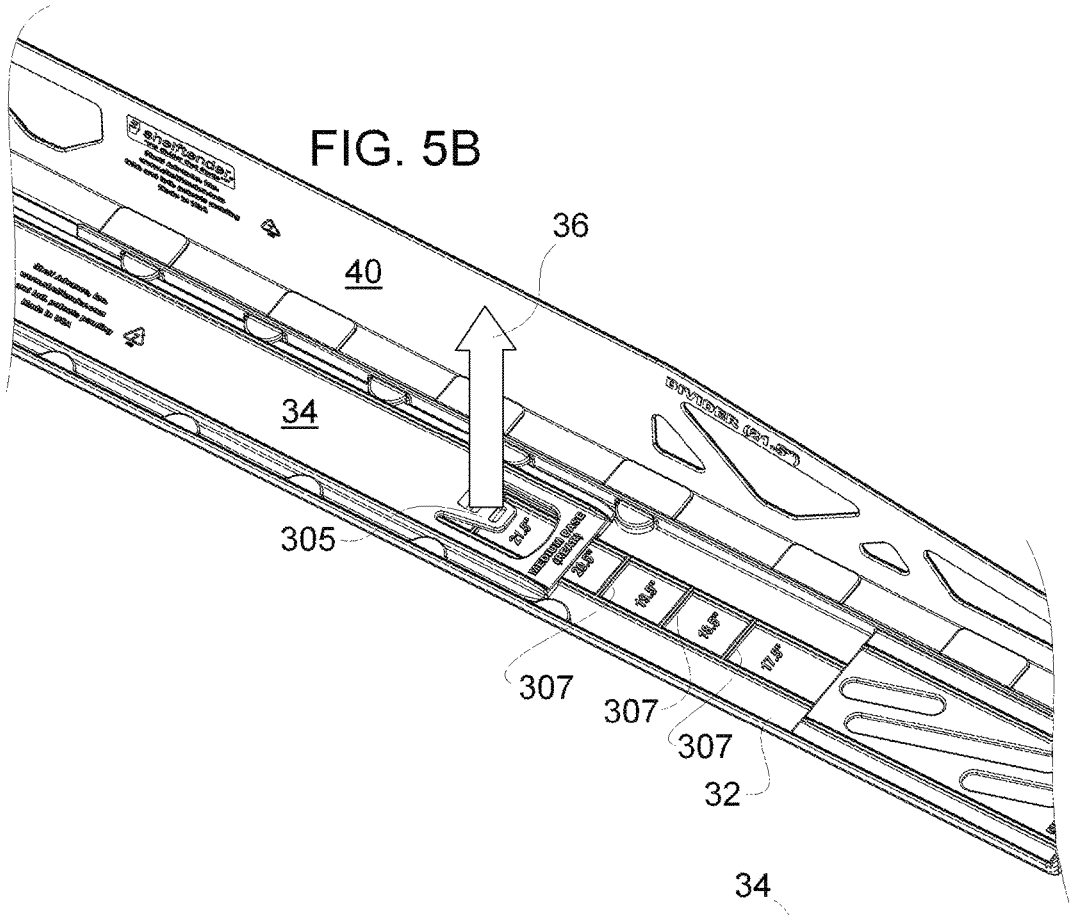
FIG. 5B is a perspective view of the shelf allocation and management unit of FIG. 5A with the two-piece length-adjustable telescoping base showing how the base is lengthened or shortened by releasing a locking mechanism.
Figure 5C:
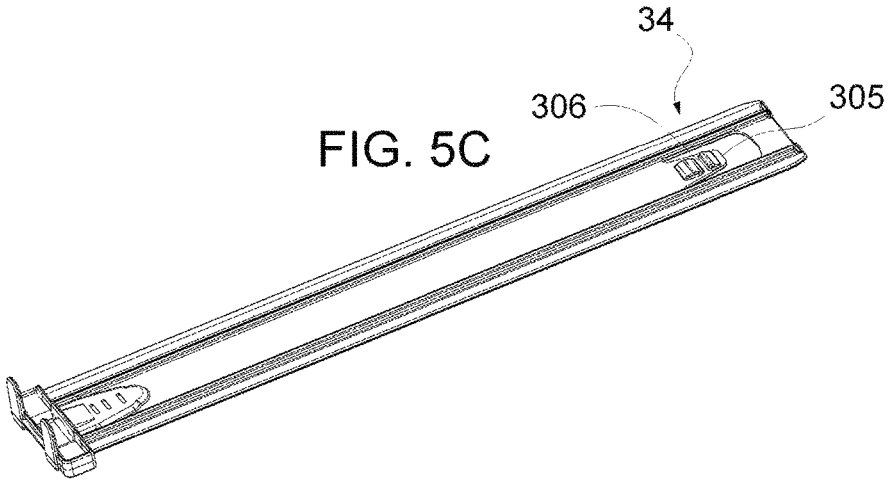
FIG. 5C is an enlarged perspective view of the underside of a rear base part of the two-piece length-adjustable telescoping base of the shelf allocation and management unit of FIG. 5A showing an underside of a release tab with a locking notch designed to couple with locking bars on the front base part.

Though a two-piece length-adjustable base may be achieved in several different ways, one mechanically feasible way is through a telescoping design as shown in FIGS. 5A and 5B. This telescoping embodiment would be comprised of front base part 32 which would couple, via telescoping means, with rear base part 34. In FIG. 5A, arrow 35 indicates the direction of adjustment to make base 30 longer. Obviously, adjustment in the opposite direction would make base 30 shorter. The adjustment of such a telescoping base 30 length may be effectuated through use of a release tab 305, as shown in FIG. 5B, or similar easily operable means. In the telescoping embodiment, the release tab 305 is positioned on the rear base part 34. As shown in FIG. 5C, the release tab 305 underside features a female receiving notch 306 shaped to couple with any of a series of corresponding male locking bars 307 that are positioned on the front base part 32, and these locking bars 307 would be positioned, for example, in one inch increments along the length. While pulling up (in direction indicated by arrow 36) and holding the release tab 305 in the open position the female receiving notch 306 is disengaged from the locking bar 307 which enables the operator to then collapse or lengthen the two-piece base 30 to achieve the desired base 30 length. To set the base 30 at the new length the operator lifts release tab 305 and aligns release tab 305 (and receiving notch 306) with the desired bar 307 and then allows the release tab 305 to spring back to the normal position thereby allowing receiving notch 306 to capture and hold bar 307 and setting the base 30 at the new length. The mechanism described above is one of many methods for simply and rapidly effectuating length adjustment of a telescoping base 30. Note that equivalent mechanical function is achieved if the release tab 305 were integral to front base part 32 and the locking bars integral to rear base part 34.

An alternative design for a length-adjustable base, as disclosed in the '527 patent is a base 30 that is assembled of at least three parts. In order to achieve a length adjustment, this multi-piece base 30 must be disassembled into the three pieces: base 30, base component 30' and base coupling part 250 and then re-assembled using base 30, base coupling part 250 and a different length base component 30'. Lengthening or shortening using the disassembly and re-assembly method is significantly more time consuming than simply adjusting a two-piece length adjustable base 30. Another disadvantage of the disassembly-then-reassembly method is that the store could not make the length adjustment without delay if it did not order the correct components (e.g. base component 30' of the correct length) or ordered them but cannot locate them after months or years of storage.

A further advantage of a two-piece length-adjustable telescoping base 30 for the manufacturer and seller of the systems 20 is that fewer parts need to be manufactured and held in inventory. As suggested above, this advantage also accrues to the end user as the length adjustment feature is integral to the telescoping base 30 as delivered with no need to assemble or add separate parts.

The length of base 30 of the units 20 of the present system 10 must correspond to the depth of the store shelf 12 as this allows, if store management desires, the full depth of the shelf 12 to be utilized. Further, the method for longitudinally stabilizing the base 30 on a shelf 12 requires that the base 30 be the same length as the shelf 12 depth.

The units 20 of the present system 10 are comprised of a base 30 coupled to a sliding side divider 40. A backstop 60 is attached to the rear end of the sliding side divider 40 and the backstop 60 prevents merchandise 14 from traveling rearward beyond the position of the backstop 60. The front of the sliding side divider 40, when the sliding side divider 40 is at the storage (non-fronting) position is aligned with the front of the base 30 and the front edge of the shelf 12. As explained above, the front of sliding side divider 40 is prevented from traveling rearward of the front of base 30 via divider stop 42. Therefore, for example, a shelf 12 with a depth of 21.5" may be effectively shortened to a depth of 17.5" if a sliding side divider 40 (with backstop 60) with a 17.5" length is used provided that sliding side divider 40 features a divider stop 42. The effective shelf depth is the distance from the front of base 30 (which is aligned with front of the shelf 12) to the position of backstop 60 of a unit 20. (As backstop 60 is always positioned at the rear end of sliding side divider 40, the effective shelf 12 depth is the length of sliding side divider 40 when it features divider stop 42.)

A system 10 featuring length-adjustable bases 30 coupled to fixed-length sliding side dividers 40 is highly functional. In some cases a store will want both the base 30 and the sliding side divider 40 to match the shelf 12 depth in which case they would order length-adjustable bases 30 along with fixed-length sliding side dividers 40 to match the various shelf 12 depths. In other some cases a store will order length-adjustable bases 30 along with perhaps two sizes of fixed-length dividers, for example 17.5" and 21.5". Although a retail store may be originally outfitted with a wide variety of shelf 12 depths (for example 17.5", 18.5", 19.5" and 24.5") store management, in actual practice, frequently prefers to shorten the effective shelf 12 depth and may prefer to employ, for example, only two effective shelf 12 depths (for example 17.5" and 21.5"). One reason stores may prefer to shorten the effective shelf 12 depth is to reduce the amount of inventory the store must maintain on its shelves 12 in order to provide sufficient merchandise 14 at the front of the shelf 12 even for merchandise 14 that sells at relatively high rates. The present shelf allocation and management system 10 allows stores to bring merchandise 14 forward to the front shelf 12 edge—and into selling position—much more rapidly as compared to the legacy practice where clerks are forced to reach to the middle or rear of the shelf 12 and grasp individual merchandise 14 packages to draw them forward. Without a system to rapidly bring stock forward stores, in order to more easily and quickly position merchandise 14 at the front of the store shelves 12, in some occasions will order new cases of merchandise 14 and place that new merchandise 14 on the shelf 12 front even though, if they had taken the time to bring it forward, there existed sufficient merchandise 14 at the middle and rear of the shelf 12 to replenish the forward area (selling position) of the shelf 12. This practice of "overloading" the shelves 12 often requires use of the full depth of the shelf [e.g. 24.5'] because new cases of merchandise 14 typically contain 12 or 24 individual pieces of merchandise 14, and it is easier and faster to unload the entire case onto the shelf rather than placing half on the shelf 12 and storing the remainder in the back room. With a device such as the present system 10 that enables store clerks to bring merchandise 14 forward rapidly stores can maintain merchandise 14 at selling position at the front of the shelf 12 simply by bringing forward that merchandise 14 at the middle and rear of the shelf 12 and so can avoid relying on the above-described technique of "overloading." In some cases the rapid fronting feature of the present system 10 is so effective the store may be able to maintain sufficient merchandise 14 at the shelf 12 edge even with a shortened effective shelf 12 depth as would be effectuated with a sliding side divider 40 that is shorter in length than the shelf 12 depth. For example, a 24.5" shelf could be effectively shortened to 21.5", and with the rapid fronting feature the store may more readily keep the front of this shelf 12 stocked even with the shorter effective shelf 12 depth. Provided there is always sufficient merchandise 14 at or near the front edge of the shelf 12 stores prefer to carry as little merchandise 14 on the shelf 12 as possible because all pieces of merchandise 14 on the shelf 12 are an expense that the store must incur and a store naturally desires to reduce costs to the fullest extent. Therefore a store with shelf 12 depths of 17.5", 18.5", 21.5" and 24.5" may prefer units 20 of a system 10 featuring length-adjustable bases 30 that may be adjusted to, for example, 17.5", 18.5", 21.5" and 24.5" depths, but that same store may request only two sliding side divider 40 lengths, for example 17.5" and 21.5".

Another reason to shorten the effective depth of the shelf 12 is that a particular variety of merchandise 14 may be a slow seller with the result that carrying, for example, six packages of that variety on the shelf 12 may be sufficient to meet demand, as opposed to the store, for example, loading a 24.5" deep shelf with perhaps a dozen packages many of which may sit unsold on the shelf 12 for such a long period of time that they expire and must be discarded (at the store's expense). In this case a store may, for example, want to shorten the effective depth of a 24.5" shelf 12 to, for example, 17.5" thereby preventing the shelf 12 from being loaded with excess inventory.

Neither the sliding side divider 40 nor the fixed side divider 43 of a unit 20, as a practical matter, can be made adjustable in length without significantly reducing the divider's usefulness. Unless a prohibitively expensive material were used (e.g. carbon fiber) a length adjusting mechanism cannot be integrated into divider 40 or 43 without making the divider 40 or 43 much thicker. Commonly used shelf allocation and management systems use dividers that are between 0.060" and 0.15" thick. However, an adjustable-length divider 40 or 43 might have to be, for example, 0.25" thick in order to incorporate a length adjusting feature. As lateral shelf 12 space is at a high premium, in most cases a store would reject a system 10 featuring dividers 40 or 43 with a thickness of 0.20" or more. A divider 40 or 43 may be made adjustable in length through a design enabling sections on one end of the divider 40 or 43 to be snapped off and discarded although this method usually entails sacrifices in strength and appearance, and this method only allows shortening and not lengthening.

Figure 6A:
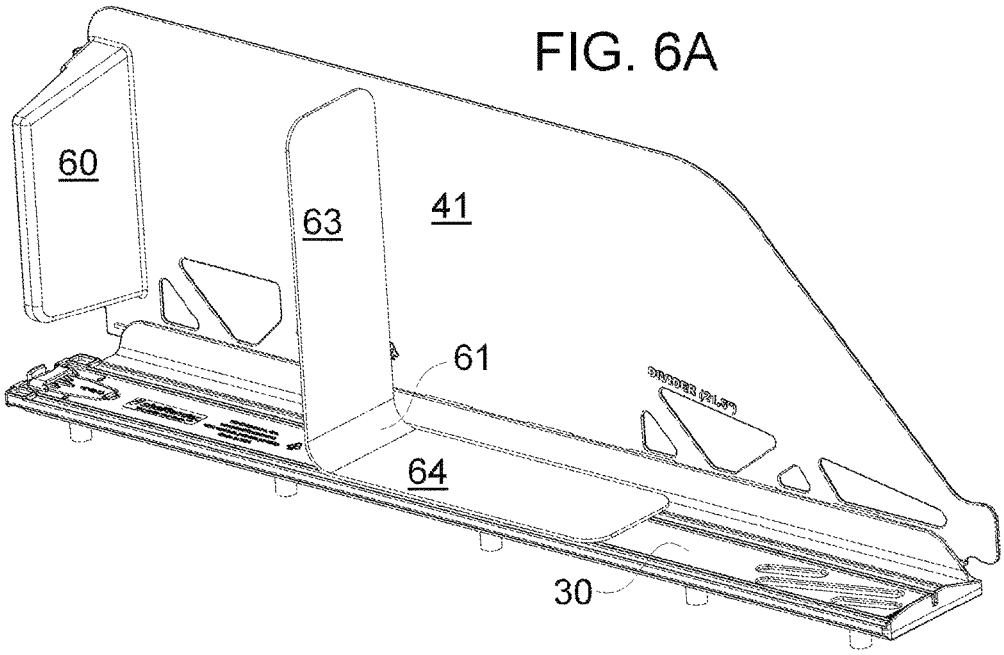
FIG. 6A is a view of a shelf allocation and management unit according to one embodiment of the present invention also including a non-tipping backstop configured to prevent merchandise with a high center of gravity from tipping over backwards.
Figure 6B:
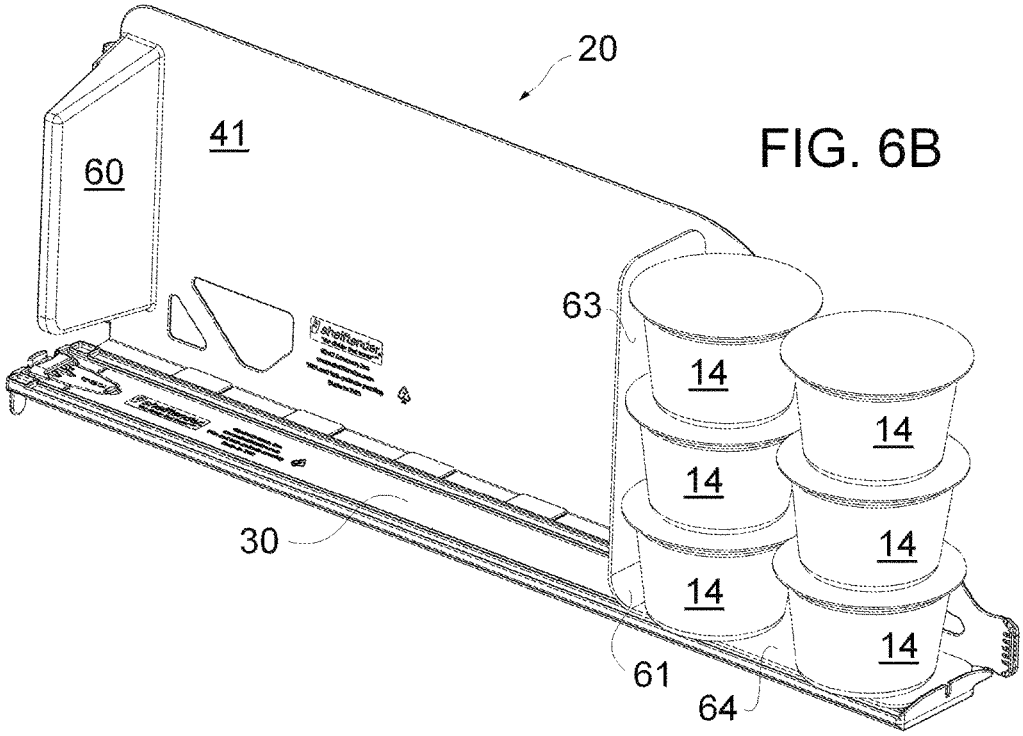
FIG. 6B is a view of the shelf allocation and management unit with a non-tipping backstop of FIG. 6A showing merchandise placed on the non-tipping backstop.

A further aspect of the present invention, as shown in FIGS. 6A and 6B, is a non-tipping backstop 61 configured to prevent merchandise 14 with a high center of gravity in a unit 20 from tipping backwards. If merchandise 14 in a unit 20 tips or falls over backwards then the store clerk must remove all of the standing merchandise 14 from the unit 20, retrieve and re-position the tipped merchandise 14 and finally replace the previously standing merchandise 14 back on the unit 20. This is a time-consuming process and should be eliminated. Many types of merchandise 14 have a low center of gravity (e.g. pasta sauce jars) and, as these types of packages rarely tip over backwards, the standard backstop 60 of a unit 20 will suffice. Some types of merchandise 14, however, have a high center of gravity and are therefore prone to tipping over. This includes, for example, tall air freshener cans and tall spray paint cans. At an even greater risk of tipping are merchandise 14 items that are stacked two-high, three-high or greater. This type of merchandise 14 stacking is often seen, for example, with single-serve yogurt cups and with baby food jars.

The non-tipping backstop 61 is used in conjunction with a unit 20 with a standard backstop 60. As shown in FIG. 6A, the non-tipping backstop 61 is shaped like an "L" and features a rear plate 63 and a tongue 64. The rear plate 63, which in most cases will be from 6" to 8" high, is attached to a tongue 64 that rests on the base 30 and protrudes forward of the rear plate 63 a distance approximately equal to the height of the rear plate 63, or approximately 7". As shown in FIG. 6B, the tongue 64 is configured so that at least two individual pieces of merchandise 14 or two stacks of merchandise 14 may be positioned on top of the tongue 64 immediately forward of (ideally touching) the rear plate 63 thereby providing weight that stabilizes the rear plate 63 of the non-tipping backstop 61. When merchandise 14 is positioned on top of the tongue 64 in this manner then the center of gravity of this collection of merchandise 14 positioned on the non-tipping backstop 61 is significantly lower than it would be were that same merchandise 14 not resting on the non-tipping backstop 61, and therefore this merchandise 14 is significantly less prone to tipping over backwards.

The non-tipping backstop 61 is not attached to the backstop 60 or the sliding side divider 40 (or divider 41 described below) or to the base 30. Rather the non-tipping backstop 61 slides freely forward and backward along the top of the base 30. The standard backstop 60 prevents merchandise 14 from falling off the rear of the base 30 and also pushes merchandise 14 forward when the sliding side divider 40 is drawn forward during row fronting. Because the default or storage position of the standard backstop 60 is at the rear of the shelf 12 the standard backstop 60 provides no support to merchandise 14 positioned on the base 30 forward of the standard backstop 60. For example, if divider 40 of a unit 20 is in the storage position and if single-serve yogurt cups are stacked three-high on a unit 20 and if a ten-inch gap exists between the standard backstop 60 and the rearmost stack of yogurt cups on the base 30 then the rearmost stack of yogurt cups will be prone to tipping over backwards when a store clerk adds new yogurt cups to the front of the unit 20. Tipping may also occur when the front of the row of yogurt cups is bumped as could occur when a shopper selects a yogurt cup for purchase. The non-tipping backstop 61 travels with and supports the rearmost pieces of merchandise 14 (or rearmost merchandise 14 stack) thereby preventing the merchandise 14 from tipping backwards regardless of how full is the row of merchandise 14 in a unit 20.

The non-tipping backstop 61 may in some embodiments feature a coupling mechanism integral to tongue 64 and corresponding features on the top of base 30 (or laterally inclined base 30) where the coupling mechanism would provide lateral stability to the non-tipping backstop 61 such that it would be prevented from moving sideways and would be prevented from tipping backward or forward, yet would freely slide backward and forward along the top of base 30 (or laterally inclined base 30) of a unit 20.

Figure 7C:
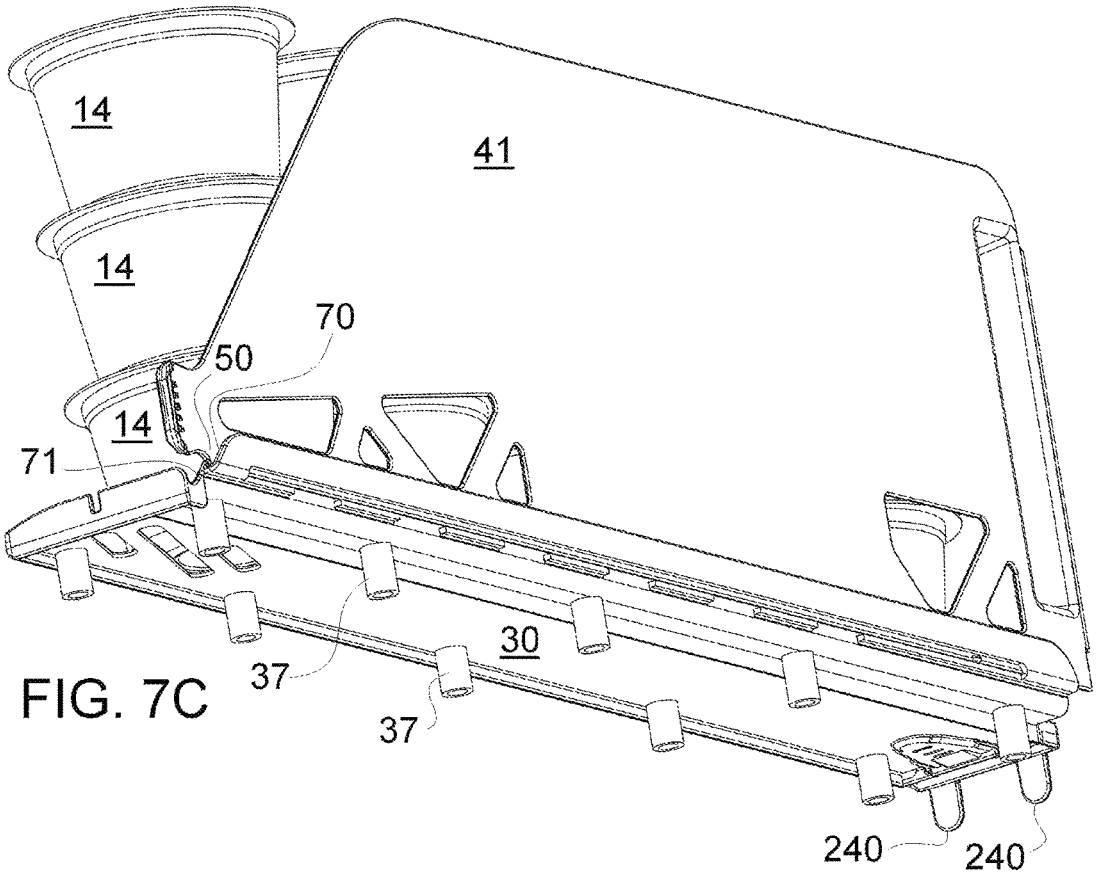
FIG. 7C is a perspective view of the shelf allocation and management unit of FIG. 7A showing features that elevate the divider.

A further aspect of the present invention, as shown in FIGS. 7A, 7B and 7C, is a shelf allocation and management unit 20 configured for use on a retail store shelf 12 with a high front lip. Some retail store shelves 12, especially in the dairy section of a supermarket, have a front lip that is approximately 0.35" high but can range from 0.15" to 0.50" high. The base 30 and sliding side divider 40 combination disclosed in '527 patent features a bottom of a sliding side divider 40 that is approximately 0.10" above the top of the shelf 12, so this sliding side divider 40 will be prevented from being drawn forward for row fronting if the unit 20 is on a shelf 12 with a front lip higher than 0.10".

In the present disclosure, as shown in FIG. 7A the base 30 of a unit 20 features bend and riser 71 which together re-position channel 70 to an orientation ninety degrees counter-clockwise (in other words, pointing upward) so that channel 70 will accept a modified sliding side divider 41 that is completely flat and oriented in a vertical position. A unit 20 with base 30 and bend and riser 71 that orients channel 70 in a vertical position would be coupled with sliding side divider 41 which is similar to sliding side divider 40, but the connecting tab 50 of sliding side divider 41, rather than oriented perpendicularly, is on the same vertical plane as sliding side divider 41. Sliding side divider 41 is completely flat rather than "L" shaped like sliding side divider 40. (Sliding side divider 40 with integral perpendicular-oriented connecting tab 50 is necessary for a regular base 30 with a channel 70 that is oriented laterally and not vertically.) In the case, for example, of a shelf 12 lip that is 0.35" high, a unit 20 with base 30 with bend and riser 71 may raise channel 70 so that the bottom of sliding side divider 41 may be raised slightly higher than the shelf 12 lip height, for example 0.40", so that the bottom of sliding side divider 41 is higher than the lip on the shelf 12 thereby enabling the sliding side divider 41 to be drawn forward for row fronting. In contrast, the '527 patent discloses a base 30 with a channel 70 opening oriented in lateral alignment with the width of the base 30 and this configuration does not allow the bottom of a sliding side divider 40 to be raised so that it would clear a high shelf 12 lip.

Retail shelves 12 with a high front lip are common in refrigerated sections of the supermarket where, for example, yogurt, tubs of cream cheese and processed meats are displayed. Yogurt is among the highest selling areas of a supermarket so stores dedicate high numbers of man-hours to stocking and fronting the yogurt section, so the system 10, which is principally a system designed to allow easier and faster stocking and row fronting, could present significant benefits if installed in the yogurt area. The present disclosure of bend and riser 71 and vertical channel 70 may only be useful, as a practical matter, with merchandise 14 packages with a frustoconical shape where the bottom is narrow and the top is wide. When frustoconical packages 14 of this type are situated on a shelf 12 side-by-side a large lateral gap is present between the bases of the packages 14. In many cases this gap is approximately 0.50" to 1.00" wide and 1.00" to 1.75" high, and such a large gap will accommodate the significant extra thickness presented by bend and riser 71, vertical channel 70 and coupled sliding side divider 41 of the present disclosures. Merchandise 14 packages with perfectly vertical sides, such as macaroni & cheese boxes and cans of vegetables, do not present a significant lateral gap (towards the bottom) between two packages placed side-by-side and therefore the presently disclosed bend and riser 71, vertical channel 70 and sliding side divider 41 would consume too much lateral space between the merchandise 14 packages and would therefore be undesirable.

As shown in FIGS. 7A, 7B and 7C an alternative method for raising the bottom of sliding side divider 40 (or sliding side divider 41) so that it can move over and past a high shelf 12 lip is to add risers 37 to the bottom of base 30. In the case, for example, where the system 10 is installed on shelves 12 with a front lip 0.35" high, the risers 37 could be, for example, 0.40" in length which would lift base 30 and therefore bottom of sliding side divider 40 by 0.40" thereby allowing the bottom of sliding side divider 40 to ride over the shelf 12 lip. A combination of bend and riser 71 (and vertical channel 70) with risers 37 could also be used to elevate the bottom of sliding side divider 41. In some cases stores prefer to display merchandise 14 stacked, for example, 3-high and there may be limited clearance between the top of the 3-high merchandise 14 stack and the next shelf 12 above. In this case the use of risers 37 may not be practical as they could lift the base 30 of unit 20 too high from the top surface of the shelf 12 thereby eliminating the necessary vertical clearance for the 3-high merchandise 14 stack. In this case a unit 20 with no base risers 37 but rather employing bend and riser 71, vertical channel 70 and sliding side divider 41 would be preferred.

It is understood, therefore, that this invention is not limited to the particular embodiments disclosed, but it is intended to cover modifications that are within the spirit and scope of the invention, as defined by the appended claims and equivalents thereto.

What is claimed is:

1. A bottom supporting shelf allocation and management system for allocating shelf space among rows of products, the system comprises:

a plurality of adjacent shelf allocating and managing units, each unit associated with at least one row of products, wherein each unit includes:

a base substantially corresponding in length to a depth of a shelf where the base is adapted to rest on the shelf and to support the at least one row of products, a perpendicular side divider approximately the same length as the base where the side divider extends vertically above the base and is removeably attached to the side edge of the base and where the coupling of the side divider and base locks the side divider and base in a fixed lateral position but enables the side divider to manually slide forward and backward along the length of the base while the base remains stationary, a backstop attached to the rear of the side divider and protruding laterally across the base which is configured, when the side divider is manually drawn forward, to make contact with a rearmost product resting on the base and will push the rearmost product and any other products on the base forward in sympathy to the forward movement of the side divider, and at least one of a front catch coupled to the base and configured to engage a front edge of the shelf preventing unwanted rearward movement of the base, and a rear catch configured to engage a rear edge of the shelf preventing unwanted forward movement of the base.

2. The bottom supporting shelf allocation and management system for allocating shelf space among rows of products according to claim 1 further including a rear gap filler attached to the rear end of the base configured to fill any gap that exists between the rear edge of the shelf and the wall behind the shelf thereby preventing unwanted backward movement of the shelf allocation and management unit and where the rear gap filler would allow the shelf allocation and management unit to move freely to the left or right, and wherein the rear gap filler may be adjusted to various positions so that gaps of varying sizes that exist between the rear edge of the shelf and the wall behind the shelf may be addressed.

3. The bottom supporting shelf allocation and management system for allocating shelf space among rows of products according claim 2 wherein the rear gap filler includes a spring-biased flexing mechanism that enables the rear gap filler to maintain constant contact with the wall behind the shelf and urges the rear gap filler and the attached base of the shelf allocation and management unit forward so that it is maintained in a constant front-to-back position.

4. The bottom supporting shelf allocation and management system for allocating shelf space among rows of products according claim 1 wherein the base is formed as a two-piece base that may be lengthened or shortened by changing the position of the two base components relative to one another.

5. The bottom supporting shelf allocation and management system for allocating shelf space among rows of products according claim 1 further including a product supporting surface of each base which is inclined in a lateral direction and towards the divider of the shelf management unit.

6. The bottom supporting shelf allocation and management system for allocating shelf space among rows of products according claim 1 further including a fixed side divider attached to the side edge of a base opposite the side edge to which the sliding side divider is attached.

7. The bottom supporting shelf allocation and management system for allocating shelf space among rows of products according claim 1 further including one of anti-skid or magnetic material on a bottom surface that prevents the shelf management unit from moving out of lateral position on the shelf.

8. The bottom supporting shelf allocation and management system for allocating shelf space among rows of products according claim 1 wherein the backstop that is shaped so that, during row fronting, at least the rearmost product is urged towards the sliding divider.

9. The bottom supporting shelf allocation and management system for allocating shelf space among rows of products according claim 1 further including a stop on a front of the divider of a unit where the stop prevents the front of the divider from traveling rearward of the front of the base.

10. The bottom supporting shelf allocation and management system for allocating shelf space among rows of products according claim 1 further including a non-tipping backstop that provides constant support to the rearmost piece of merchandise or stack of merchandise such that the merchandise or merchandise stack cannot fall over backwards regardless of the position of the rearmost merchandise or merchandise stack on the base.

11. The bottom supporting shelf allocation and management system for allocating shelf space among rows of products according claim 1 further including risers on a bottom of the base of a unit that raise the bottom of the divider above a high front lip on a shelf enabling the divider to pass over the shelf lip during row fronting.

12. A bottom supporting shelf allocation and management system for allocating shelf space among rows of products, the system comprises:

a plurality of adjacent shelf allocating and managing units, each unit associated with at least one row of products, wherein each unit includes:

a base substantially corresponding in length to a depth of the shelf where the base is adapted to rest on the shelf and to support the at least one row of products, with a product supporting surface of each base which is inclined in a lateral direction and towards the divider of the shelf management unit;

a perpendicular side divider approximately the same length as the base where the side divider is removeably attached to the side edge of the base and where the coupling of the side divider and base locks the side divider and base in a fixed lateral position but enables the side divider to slide forward and backward along the length of the base while the base remains stationary, wherein the side divider includes a side divider stop that prevents the front of the side divider from traveling rearward of the front of the base; and a backstop attached to the rear of the side divider and protruding laterally across the base which is configured, when the side divider is drawn forward, to make contact with a rearmost product resting on the base and will push the rearmost product and any other products on the base forward in sympathy to the forward movement of the side divider.

13. The bottom supporting shelf allocation and management system for allocating shelf space among rows of products according claim 12 further including a front catch coupled to the base and configured to engage a front edge of the shelf preventing unwanted rearward movement of the base.

14. The bottom supporting shelf allocation and management system for allocating shelf space among rows of products according claim 12 further including a rear catch configured to engage a rear edge of the shelf preventing unwanted forward movement of the base.

15. The bottom supporting shelf allocation and management system for allocating shelf space among rows of products according claim 12 wherein the base is formed as a two-piece base that may be lengthened or shortened by changing the position of the two base components relative to one another.

16. The bottom supporting shelf allocation and management system for allocating shelf space among rows of products according claim 12 further including a non-tipping backstop that provides constant support to the rearmost piece of merchandise or stack of merchandise such that the merchandise or merchandise stack cannot fall over backwards regardless of the position of the rearmost merchandise or merchandise stack on the base.

17. A bottom supporting shelf allocation and management system for allocating shelf space among rows of products, the system comprises:

a plurality of adjacent shelf allocating and managing units, each unit associated with at least one row of products, wherein each unit includes:

a base substantially corresponding in length to a depth of the shelf where the base is adapted to rest on the shelf and to support the at least one row of products, wherein the base is formed as a two-piece base that may be lengthened or shortened by changing the position of the two base components relative to one another, a perpendicular side divider approximately the same length as the base where the side divider extends vertically above the base and is removeably attached to the side edge of the base and where the coupling of the side divider and base locks the side divider and base in a fixed lateral position but enables the side divider to slide forward and backward along the length of the base while the base remains stationary, and a backstop attached to the rear of the side divider and protruding laterally across the base which is configured, when the side divider is drawn forward, to make contact with a rearmost product resting on the base and will push the rearmost product and any other products on the base forward in sympathy to the forward movement of the side divider.

18. The bottom supporting shelf allocation and management system for allocating shelf space among rows of products according to claim 17 wherein the two piece base is a telescoping design such that the base may be lengthened or shortened by either extending or collapsing the two base components.

19. The bottom supporting shelf allocation and management system for allocating shelf space among rows of products according to claim 17 further including a front catch coupled to the base and configured to engage a front edge of the shelf preventing unwanted rearward movement of the base, and a rear catch configured to engage a rear edge of the shelf preventing unwanted forward movement of the base.

* * * * *